US006101352A

United States Patent [19]

Hashimoto et al.

[11] Patent Number: 6,101,352

[45] Date of Patent: Aug. 8, 2000

[54] DEVELOPING CARTRIDGE FOR DEVELOPING AN ELECTROSTATIC IMAGE FORMED ON AN IMAGE BEARING MEMBER WITH TONER AND BEING DETACHABLY MOUNTABLE TO A MAIN ASSEMBLY OF AN IMAGE FORMING APPARATUS

[75] Inventors: Kouji Hashimoto, Numazu; Yoshiro Tsuchiya, Yokohama; Kenji Matsuda, Numazu, all of Japan

[73] Assignee: Canon Kabushiki Kaisha, Tokyo, Japan

[21] Appl. No.: 08/943,690

[22] Filed: Oct. 3, 1997

[30] Foreign Application Priority Data

Oct. 7, 1996 [JP] Japan ..... 8-265783
Oct. 2, 1997 [JP] Japan ..... 9-269901

[51] Int. Cl.[7] ..... G03G 15/00

[52] U.S. Cl. ..... 399/119; 399/103

[58] Field of Search ..... 399/110, 111, 399/102, 103, 105, 106, 113, 119

[56] References Cited

U.S. PATENT DOCUMENTS

| | | | |
|---|---|---|---|
| 4,707,108 | 11/1987 | Akio | 399/227 |
| 4,931,838 | 6/1990 | Ban et al. | 399/106 |
| 5,040,031 | 8/1991 | Hayashi | 395/114 |
| 5,153,649 | 10/1992 | Park | 399/110 |
| 5,561,496 | 10/1996 | Sugiura et al. | 399/107 |
| 5,579,085 | 11/1996 | Miyabe et al. | 399/111 |
| 5,619,309 | 4/1997 | Yashiro et al. | 399/111 |
| 5,642,187 | 6/1997 | Nomura et al. | 399/111 |
| 5,650,841 | 7/1997 | Matsuda et al. | 399/11 |
| 5,678,139 | 10/1997 | Nomura et al. | 399/111 |
| 5,697,022 | 12/1997 | Matsuda et al. | 399/102 |
| 5,774,766 | 6/1998 | Karakama et al. | 399/111 |
| 5,781,831 | 7/1998 | Matsuzaki et al. | 399/119 |
| 5,907,749 | 5/1999 | Nomura et al. | 399/113 |

FOREIGN PATENT DOCUMENTS

| | | |
|---|---|---|
| 0 613 060 A2 | 8/1994 | European Pat. Off. . |
| 0708387 A2 | 4/1996 | European Pat. Off. . |
| 0718717 A2 | 6/1996 | European Pat. Off. . |
| 0740229 A2 | 10/1996 | European Pat. Off. . |
| 7-077864 | 3/1995 | Japan . |
| 9-34337 | 2/1997 | Japan . |
| 9-969958 | 4/1997 | Japan . |
| 9-197792 | 7/1997 | Japan . |

*Primary Examiner*—Quana Grainger
*Attorney, Agent, or Firm*—Fitzpatrick, Cella, Harper & Scinto

[57] ABSTRACT

A developing cartridge is provided for developing a latent image formed on a photosensitive member. The developing cartridge is detachably mountable to a main assembly of an electrophotographic image forming apparatus. The developing cartridge includes a developing member for developing a latent image formed on the photosensitive member with toner; a toner accommodating portion for accommodating the toner to be used for development by the developing member; a toner supply opening, provided in the toner accommodating portion, for supplying the toner accommodated in the toner accommodating portion to the developing member; a toner seal for blocking the toner from being supplied from the toner supply opening toward the developing member; a developing frame including a developing member mounting portion for mounting the developing member, the developing frame being provided with a toner passing opening for passing the toner supplied from the toner supply opening; a toner frame supporting the toner accommodating portion; and a toner seal opening provided between the toner passing opening of the developing frame and a bonding portion between the toner frame and the developing frame.

6 Claims, 10 Drawing Sheets

DEVELOPING CARTRIDGE FOR DEVELOPING AN ELECTROSTATIC IMAGE FORMED ON AN IMAGE BEARING MEMBER WITH TONER AND BEING DETACHABLY MOUNTABLE TO A MAIN ASSEMBLY OF AN IMAGE FORMING APPARATUS

FIELD OF THE INVENTION AND RELATED ART

The present invention relates to a developing cartridge usable with an electrophotographic image forming apparatus such as an electrophotographic copying machine, a printer or the like, and an electrophotographic image forming apparatus using the same.

The term "electrophotographic image forming apparatus" refers to an apparatus which forms an image on a recording material using an electrophotographic image forming process. It includes, for example, an electrophotographic printer (LED printer, laser beam printer), an electrophotographic printer type facsimile machine and an electrophotographic printer type word processor.

Recently, demand for a color electrophotographic image forming apparatus capable of forming color images, has been increasing.

In a known color developing cartridge, all of the four color developing cartridges are carried on a turret (for example, U.S. Pat. No. 4,707,108, or U.S. Pat. No. 5,040,031). Such a structure is very effective in color image formation. The present invention is directed to a further development in this area.

In such a developing cartridge, the toner accommodating portion is openably sealed by a toner seal (U.S. Pat. No. 4,931,838 for example). This is very effective, and the present invention is directed to a further improvement.

SUMMARY OF THE INVENTION

Accordingly, it is a principal object of the present invention to provide a developing cartridge and an electrophotographic image forming apparatus in which leakage of toner is effectively prevented.

It is another object of the present invention to provide a developing cartridge and an electrophotographic image forming apparatus in which toner can be efficiently accommodated.

It is a further object of the present invention to provide a developing cartridge and an electrophotographic image forming apparatus which can be downsized.

It is a further object of the present invention to provide an developing cartridge and an electrophotographic image forming apparatus, in which a toner frame and a developing frame are bonded all around their peripheries.

It is a further object of the present invention to provide developing cartridge in which a toner seal opening is provided between a toner passing opening of a developing frame and the bonded portion.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described. First a description will be provided as to a structure of a color electrophotographic image forming apparatus, and then as to a structure of a color developing cartridge used therewith. (General arrangement of color electrophotographic image forming apparatus)

Figure 1:
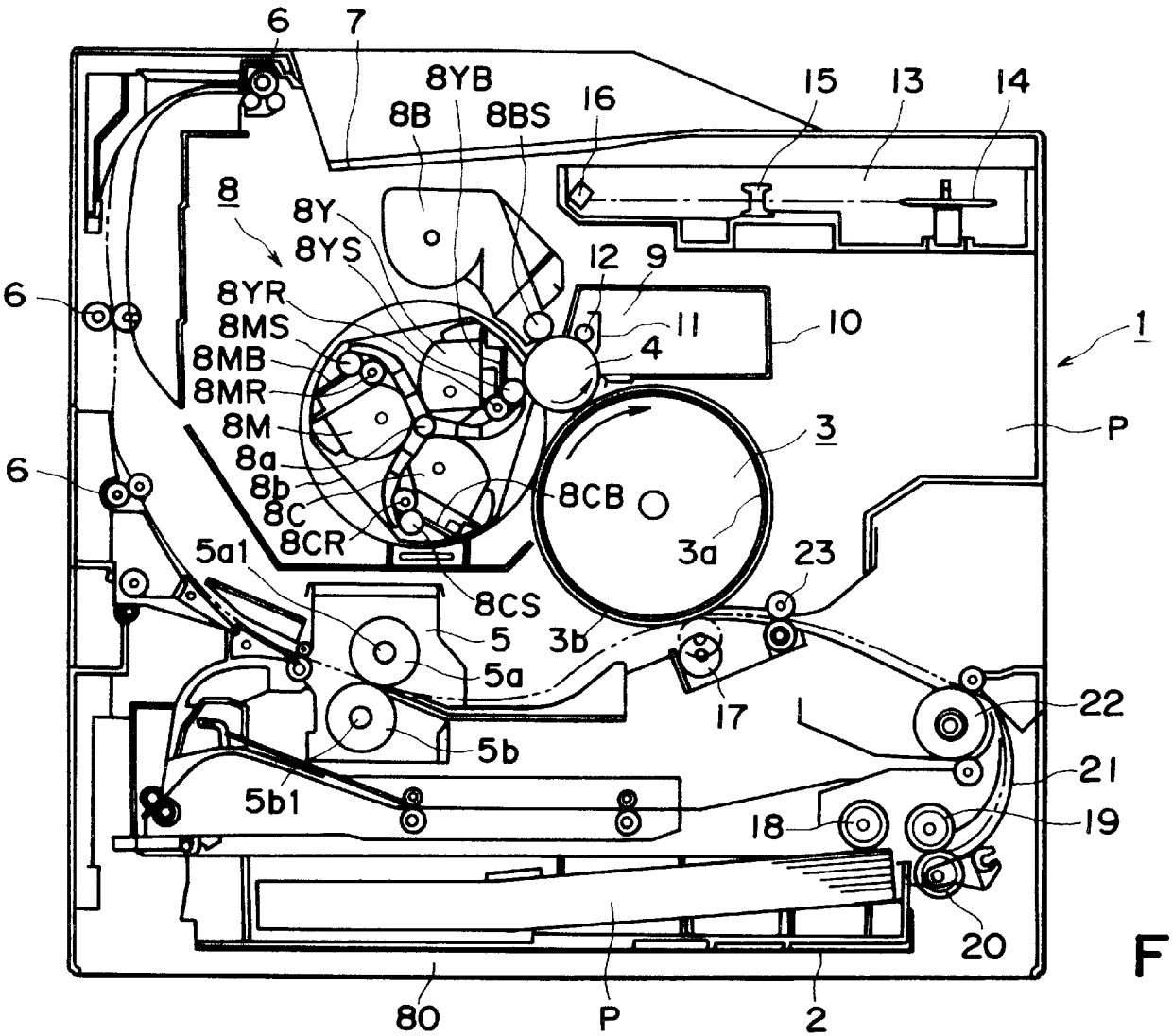
FIG. 1 is a schematic sectional view of an electrophotographic image forming apparatus using a developing cartridge according to an embodiment of the present invention.

FIG. 1 shows a general arrangement of a color laser printer used as a color electrophotographic image forming apparatus according to an embodiment of the present invention.

The color laser printer P of this embodiment comprises an electrophotographic photosensitive member in the form of a drum (photosensitive drum) 4 which rotates at a constant speed, a developing device 8B (for development with black color toner), three color development devices (yellow developing device 8Y for development with yellow color toner, magenta developing device 8M for development with magenta color toner, and a cyan developing device 8C for development with cyan color toner) detachably mountable to a rotatable or revolvable turret.

Below the photosensitive drum 4, there is provided an intermediary transfer member 3 for carrying a superposedly transferred color image and for transferring the image onto a recording material S fed from a feeding portion.

The recording material S onto which the color image has been transferred, is fed to a fixing portion 5 to fix the color image on the recording material S, and then the recording material S is discharged to a discharging portion 7 at the top of the apparatus by discharging rollers 6*a*, 6*b*, 6*c*.

The rotatably or revolvable color development devices and the fixed black developing device are detachably mountable relative to the main assembly of the printer, independently from each other.

A description will be provided as to various parts of the image forming apparatus P.

(Drum unit)

A drum unit 9 integrally contains the photosensitive drum 4 and a container 10 of a cleaning device functioning as a holder for the drum 4. The drum unit 9 is detachably mountable relative to the main assembly of the printer, and can be easily exchangeable when the lifetime of the photosensitive drum 4 is reached.

The photosensitive drum 4 of this embodiment comprises an aluminum cylinder having a diameter of approximately 62 mm and an organic photoconductive layer applied to the outside of the aluminum cylinder, and is rotatably supported on the container 10 of the cleaning device, which functions also as a housing for the photosensitive drum 4.

A cleaner blade 11 and a primary charging means 17 contact the outer peripheral surface of the photosensitive drum 4. The photosensitive drum 4 receives a driving force transmitted from a driving motor (unshown) at one longitudinal end, and is rotated in the counterclockwise direction in accordance with an image forming operation.

(Charging means)

The charging means 12 is contact charging type charger. An electroconductive roller contacts a photosensitive drum 4, and the surface of the photosensitive drum 4 is uniformly charged by application of a voltage to the electroconductive roller.

(Exposing means)

The exposure of the photosensitive drum 3 is effected by a scanner 13. More particularly, an image signal is supplied to a laser diode, and the laser diode projects a beam onto a polygonal mirror 14 at a timing corresponding to the image signal. The polygonal mirror 14 rotates at a high speed due to a scanner motor; the beam reflected by the polygonal mirror 14 is selectively projected onto the surface of the photosensitive drum 4 through an imaging lens 15 and a reflection mirror 16, so that a charge latent image is formed on the photosensitive drum 4.

(Developing means)

The developing means includes three rotary developing devices 8Y, 8M, 8C for development in yellow, magenta and cyan colors, and one black developing device 8B for development in black color to visualize the electrostatic latent image.

The black developing device 8B is a fixed developing device at a developing position for effecting the developing operation, except upon the mounting and demounting thereof relative to the main assembly of the apparatus. A developing roller 8BS is disposed opposed to the photosensitive drum 4 with a small clearance (approximately 300 $\mu$m) therebetween. It develops an image to visualize a black image with black toner on the photosensitive drum 4.

The black developing device 8B, as shown in FIG. 1, feeds the toner from the toner accommodating container toward the developing roller 8BA by a feeding mechanism 8BA. The toner application blade 8BB press-contacted to the outer periphery of the developing roller 8BS applies the toner in the form of a thin layer on the outer periphery of the developing roller 8BS, which is rotating in the indicated clockwise direction, and applies the charge to the toner (triboelectric charge). The developing roller 8BS is supplied with a developing bias, so that reverse development (jumping development) corresponding to the electrostatic latent image on the photosensitive drum 4 is effected to form a toner image on the surface of the drum.

In this embodiment, the toner capacity of the black developing device 8B is enough to print 15000 pages (A4 5% print) which is larger than twice that of the toner capacity of Y, M, C developing devices, in consideration of toner consumption corresponding to the nature of the document or image patterns printed by users.

By this, the frequency of exchange of the black developing device by the user can be reduced.

The position of the black developing device 8B is, as shown in FIG. 1, between the projection position where the photosensitive drum 4 is exposed to the beam from the laser scanner and a development position where the photosensitive drum 4 is subjected to a developing operation by the Y, M, C developing devices. Thus, the laser scanner is disposed above the developing devices. By this positional relation, the toner which might leak when the Y, M, C developing devices are revolved, is prevented from scattering to the optical parts, such as a laser scanner. Therefore, the polygonal mirror, the lens, the mirror and the like are protected from toner deposition, so that sharp output images can be provided.

On the other hand, the three revolvable developing devices 8Y, 8M, 8C each contain the toner for 6000 pages (A4 5% printing). The three revolvable developing devices are detachably mounted on a developing turret 8B which is revolvable about a shaft 8*a*.

Upon image formation, the turret 8*b* revolves about the shaft 8*a* while holding the Y, M, C developing devices to place a predetermined developing device to face the photosensitive drum 4. The developing roller 8YS of the developing device placed at the development position is disposed opposed to the photosensitive drum 4 with a small clearance (300 $\mu$m approximately), and develops the electrostatic latent image on the photosensitive drum 4 into a visualized image.

Upon color image formation, the developing turret 8*b* rotates for one rotation of the intermediary transfer member 3 so that developing processes are carried out in the order of the yellow developing device 8Y, the magenta developing device 8M, the cyan developing device 8C and the black developing device 8B.

For example, when the yellow revolvable developing device 8Y is positioned at the developing position facing the photosensitive drum unit, the yellow revolvable developing device 8Y feeds the toner from the container to the application roller 8YR by a feeding mechanism. By the functions of the application roller 8YR rotating in the clockwise direction and the blade 8YB press-contacted to the user periphery of the developing roller 8YS, a thin layer of the toner is applied on the outer periphery of the developing roller 8YS rotating in the clockwise direction in FIG. 1, and the toner is triboelectrically charged. The developing roller 8YS is supplied with a developing bias so that a latent image is developed. The development is effected through the same process as with the magenta developing device 8M and the cyan developing device 8C. The application of the bias to each developing roller and the transmission of the driving force thereto is carried out when the developing device is placed at the developing position.

(Intermediary transfer member)

The intermediary transfer member 3 superimposedly receives four visualized toner images (Y, M, C, B) from the photosensitive drum 4. It is rotated in the clockwise direction as shown in FIG. 1 in synchronism with the outer peripheral speed of the photosensitive drum 4.

The superimposed toner images on the intermediary transfer member 3 are transferred all together by a transfer roller 17 supplied with a voltage, onto a recording material S fed to and nipped between the intermediary transfer member 3 and the transfer roller 17.

The intermediary transfer member 13 in this embodiment, comprises an aluminum cylinder 3*a* having a diameter of 186 mm and an elastic layer 3B such as an intermediate resistance sponge, intermediate resistance rubber, or the like, on the outer periphery of the aluminum cylinder 3*a*. The intermediary transfer member 3 is rotatably supported and is driven by a gear (unshown) fixed thereto.

(Cleaning means)

The cleaning means functions to remove the toner on the photosensitive drum 4 after the toner image provided by the developing means on the photosensitive drum 4 is transferred onto the intermediary transfer member 3. Thereafter, the removed toner is accumulated in the cleaner container 10. Normally, the amount of the removed toner accumulated in the container 10 does not fill the container before the lifetime of the photosensitive drum is reached. Accordingly, normally the cleaner container 10 is exchanged integrally and simultaneously with the lifetime-end exchange of the photosensitive drum 4.

(Feeding portion)

The feeding portion functions to feed the recording material S into the image formation station. It comprises a cassette 2 for accommodating a plurality of recording materials S, a pick-up roller 18, a feeding roller 19, a retarding roller 20 for preventing double feeding, a feeding guide 21, and a registration roller 22.

Upon image formation, the feeding roller 18 is rotated in accordance with the image forming operation to feed the recording materials S from the cassette 2, one-by-one. The recording material S separated and fed out, is guided by a guide 21, and is introduced to the registration roller 23 by the feeding roller 22. During the image forming operation, the registration roller 23 rotates and stops at a predetermined sequence to feed the recording material S in synchronism with the transfer process.

(Transfer portion)

The transfer portion is provided with a swingable transfer roller 17. The transfer roller 17 comprises a metal shaft wrapped with an intermediate resistance foamed elastic member and a driving shaft, and is movable in the vertical direction in FIG. 1.

While the four color toner images are formed on the intermediary transfer member 3, that is, while the intermediary transfer member 3 is rotated a plurality of turns, the transfer roller 17 is at a lower position as shown in FIG. 1, and is separated from an intermediary transfer member 3 so that the toner image is not disturbed.

After the four color toner images are formed on the intermediary transfer member 3, the transfer roller 17 is urged toward an upper position indicated by chain lines in FIG. 1 at a predetermined pressure toward the intermediary transfer member 3 at a predetermined timing for transferring the color image onto the recording material S. Simultaneously therewith, the transfer roller 17 is supplied with a bias voltage so as to transfer the toner image onto the recording material S from the intermediary transfer member 3.

The recording material S nipped between the intermediary transfer member 3 and the transfer roller 17, is advanced at a predetermined speed to the left in FIG. 1 during the transfer process, and is fed to a fixing device.

(Fixing portion)

The fixing station 5 functions to fix the toner image on the recording material. As shown in FIG. 1, the fixing portion 5 comprises a fixing roller 5*a* for applying heat to the recording material S, and a pressing roller 5*b* for press-contacting the recording material S to the fixing roller 5*a*. These rollers are hollow and contain heaters 5*a*1, 5*b*1. By the rotation of the rollers, the recording material S carrying the toner image is fed by the fixing roller 5*a* and the pressing roller 5*b*, and simultaneously therewith, heat and pressure are applied by which the toner image is fixed on the recording material S.

Figure 2:
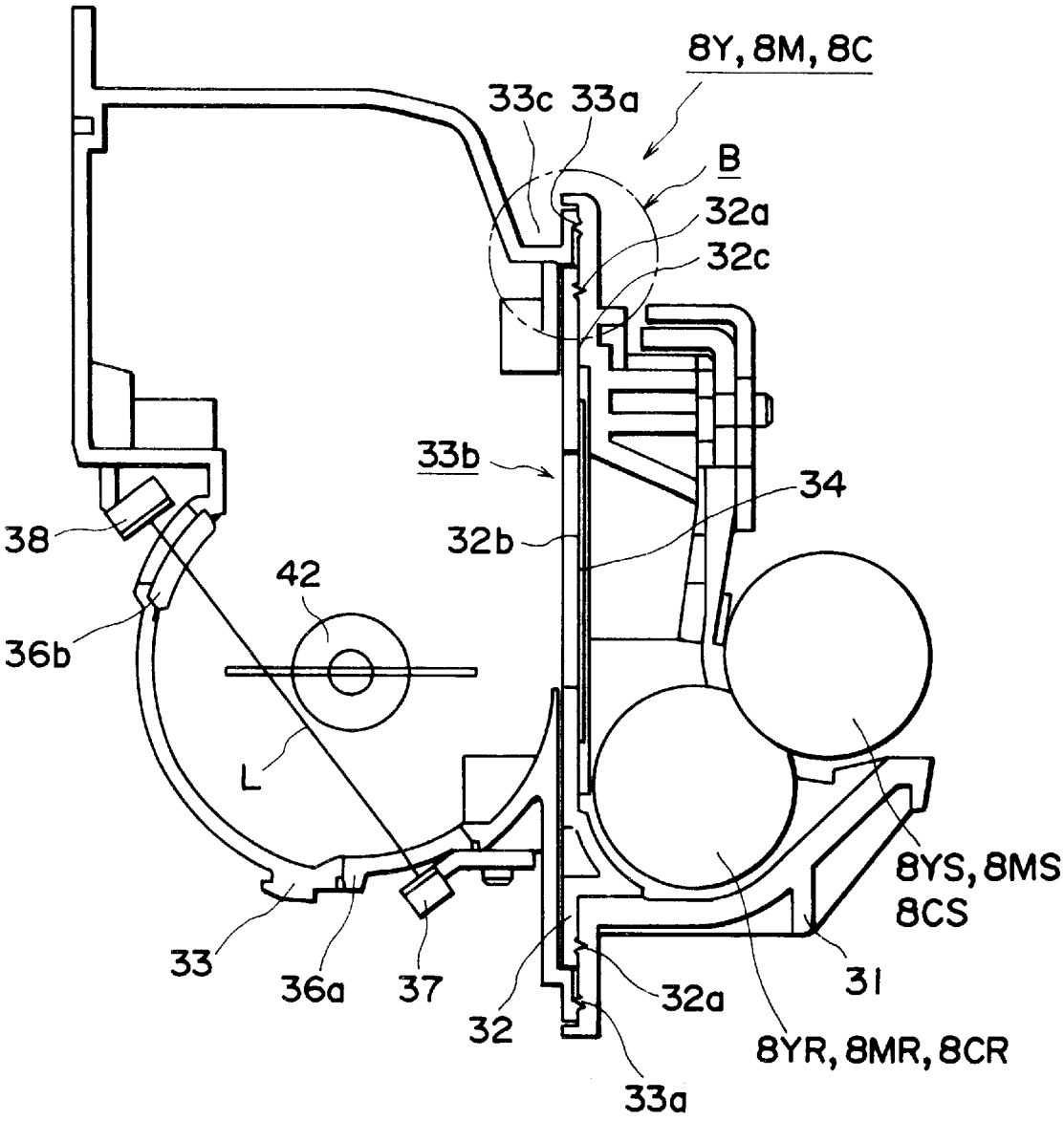
FIG. 2 is a schematic sectional view of a developing cartridge according to an embodiment of the present invention.
Figure 3:
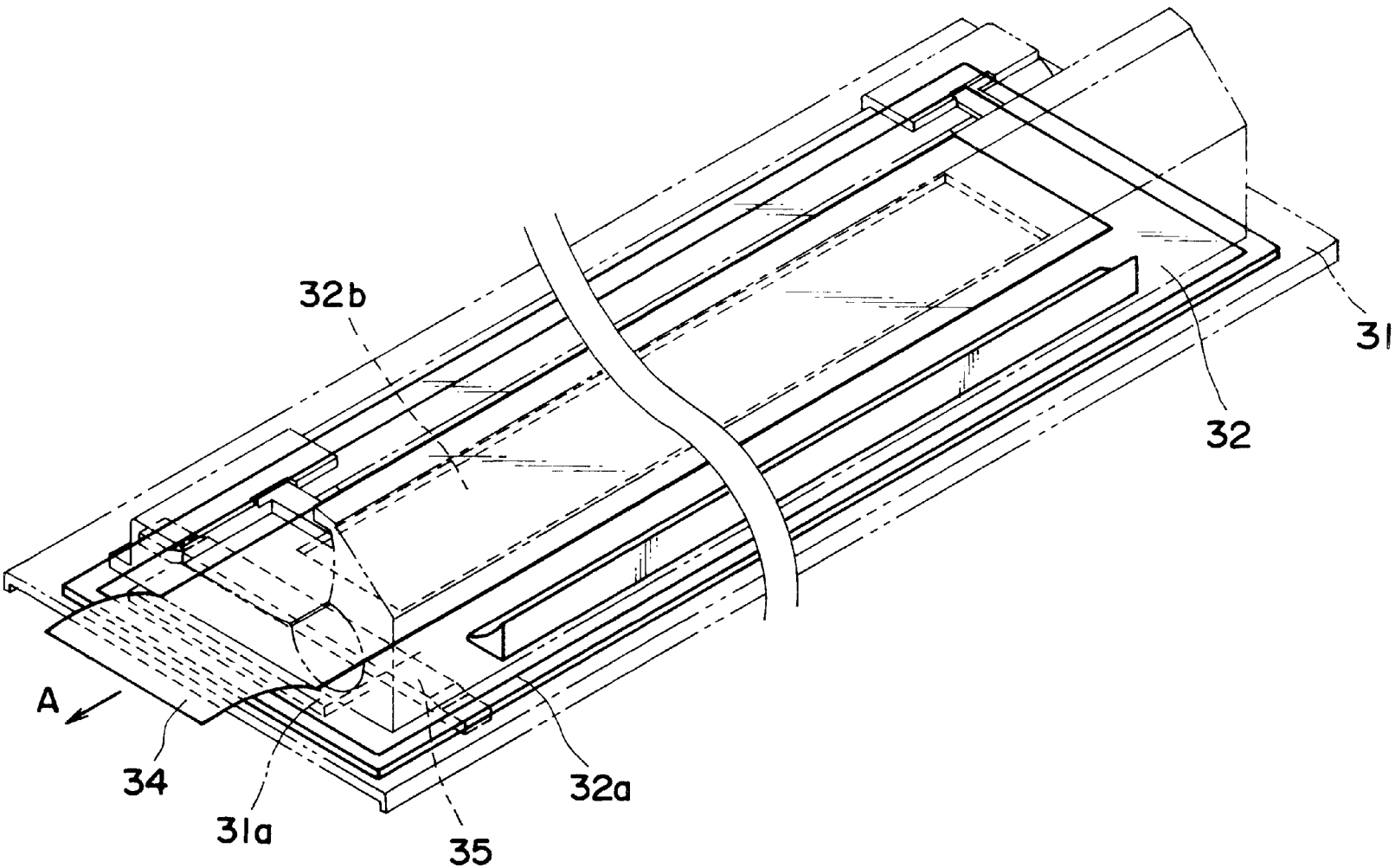
FIG. 3 is a perspective view of a seal member and elements there around of a developing cartridge according to an embodiment of the present invention.
Figure 4:
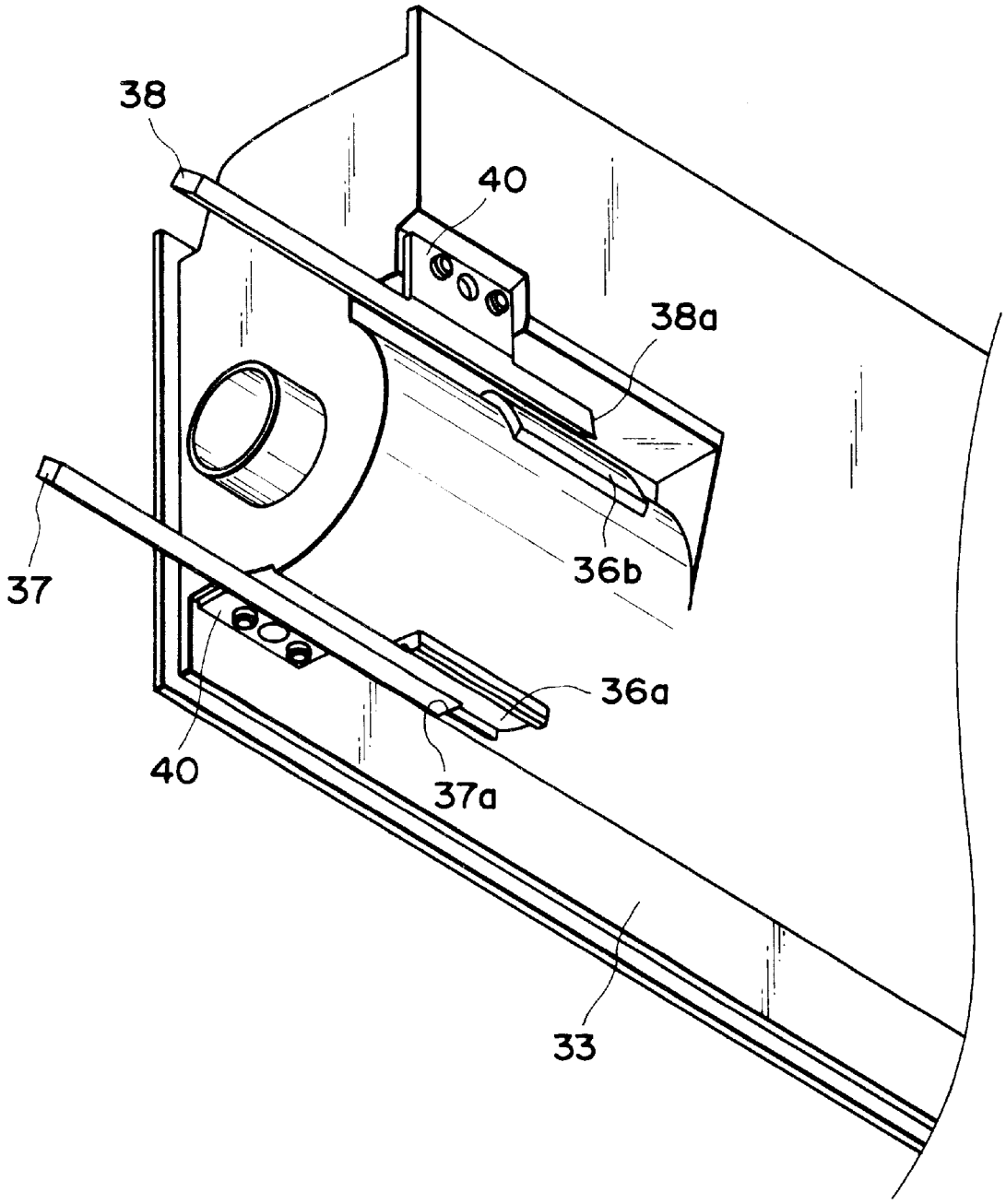
FIG. 4 is a perspective view of a light transmission member and elements there around provided in a developing cartridge according to an embodiment of the present invention.
Figure 5:
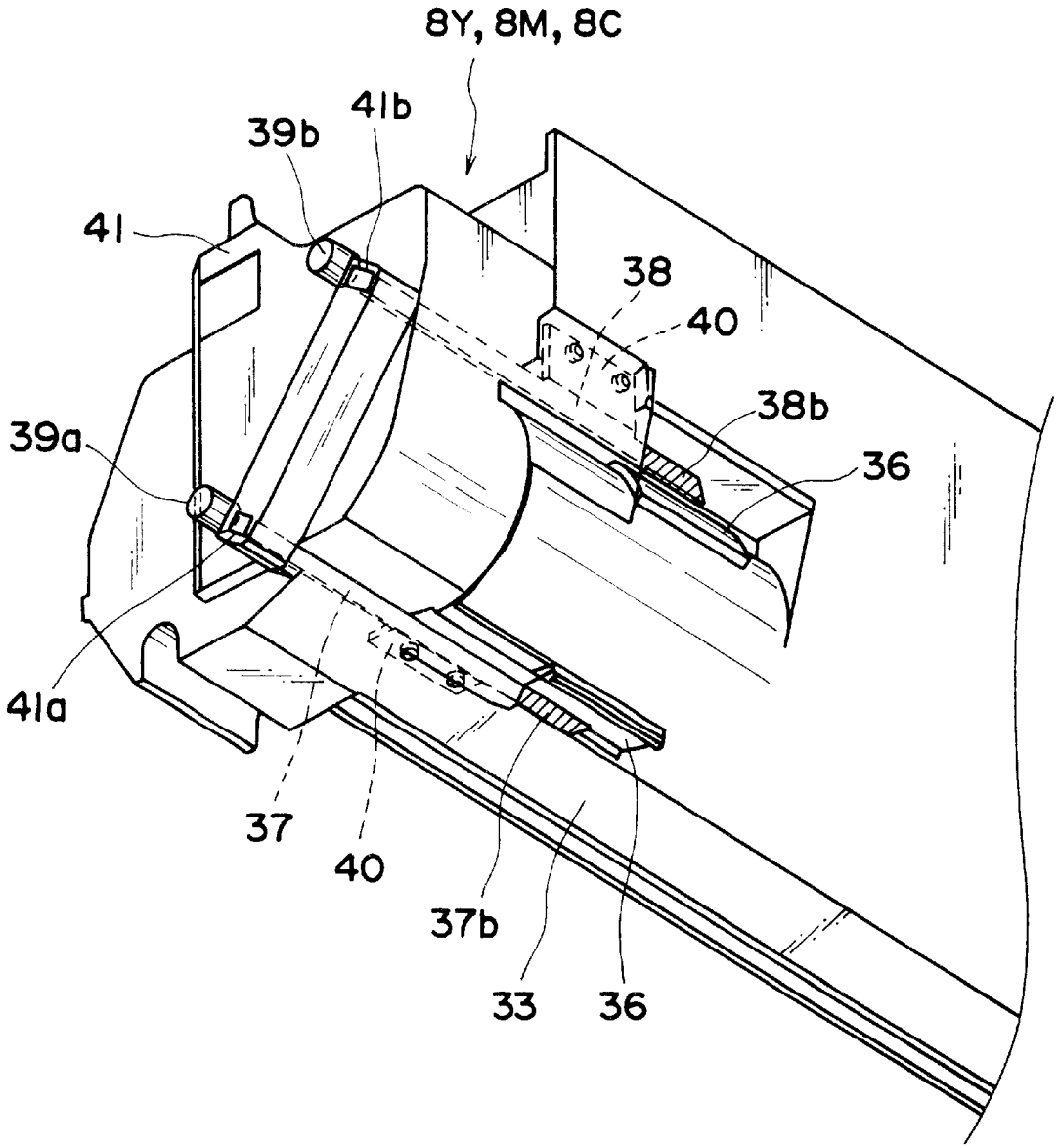
FIG. 5 is a perspective view of a light transmission member and elements there around of a light transmission port provided in a developing cartridge according to an embodiment of the present invention.
Figure 6:
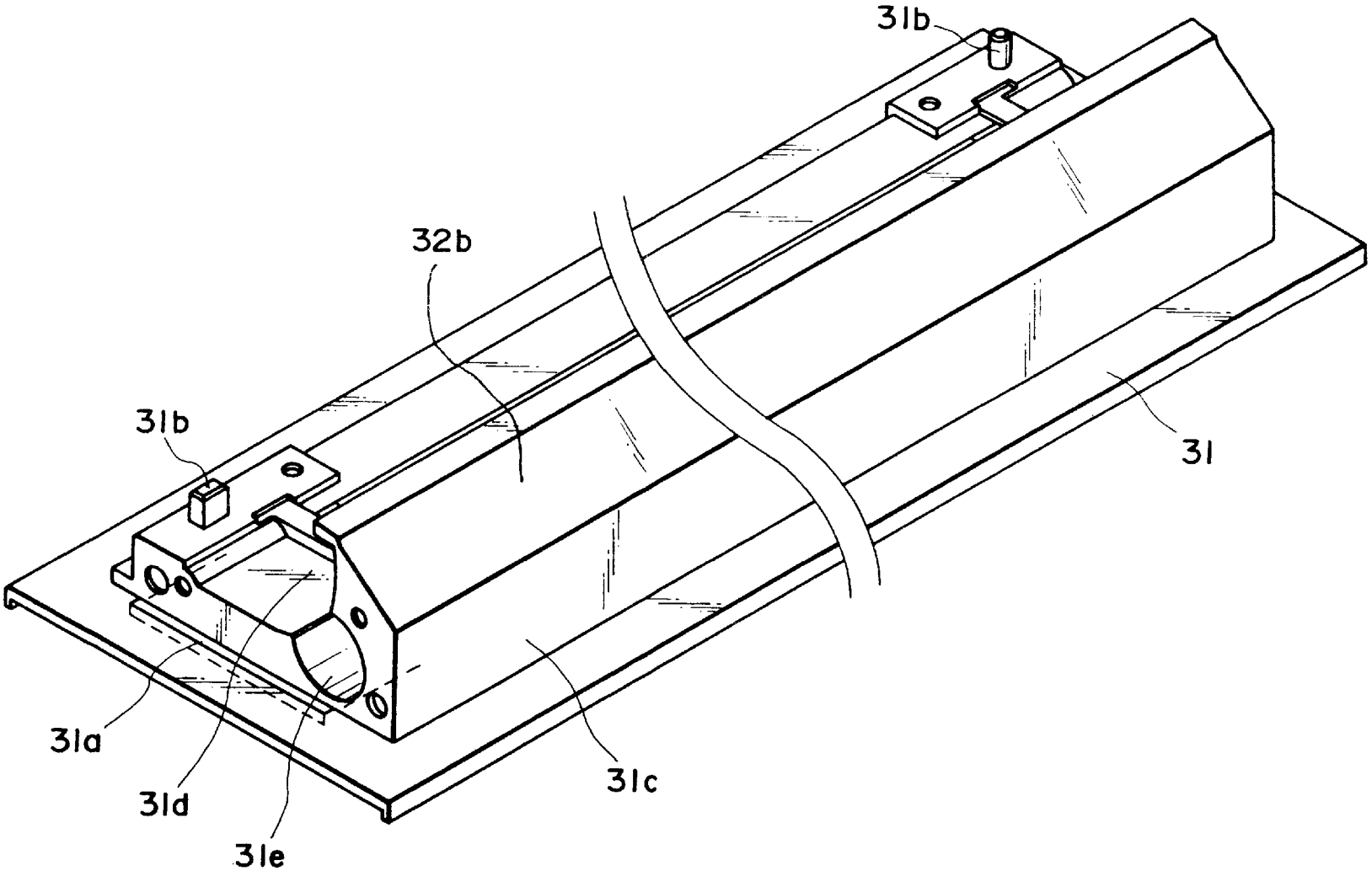
FIG. 6 is a perspective view of a toner frame according to an embodiment of the present invention.
Figure 7:
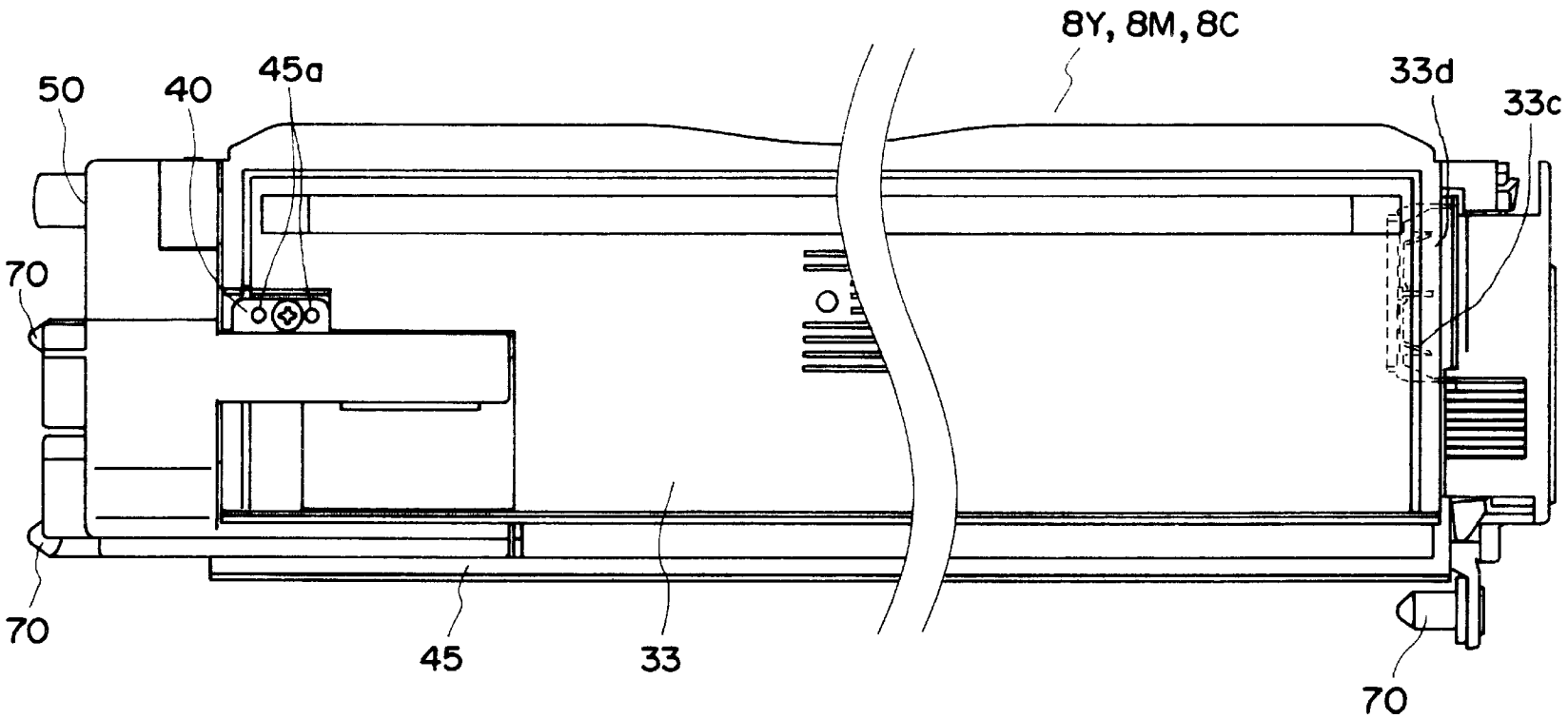
FIG. 7 is a top plan view of a developing cartridge according to an embodiment of the present invention.
Figure 8:
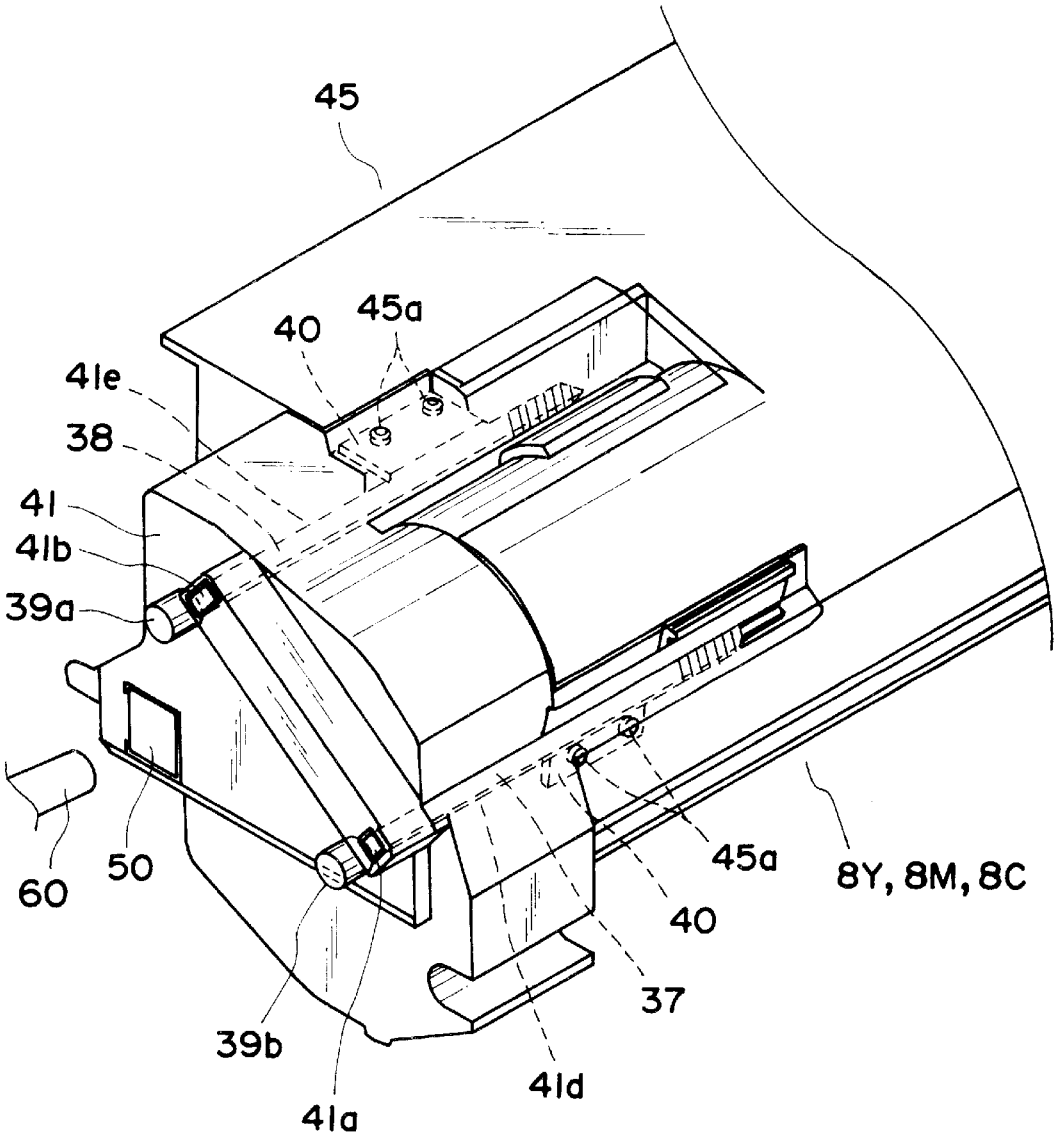
FIG. 8 is a perspective is a perspective view of an end portion of a developing cartridge according to another embodiment of the present invention.
Figure 9:
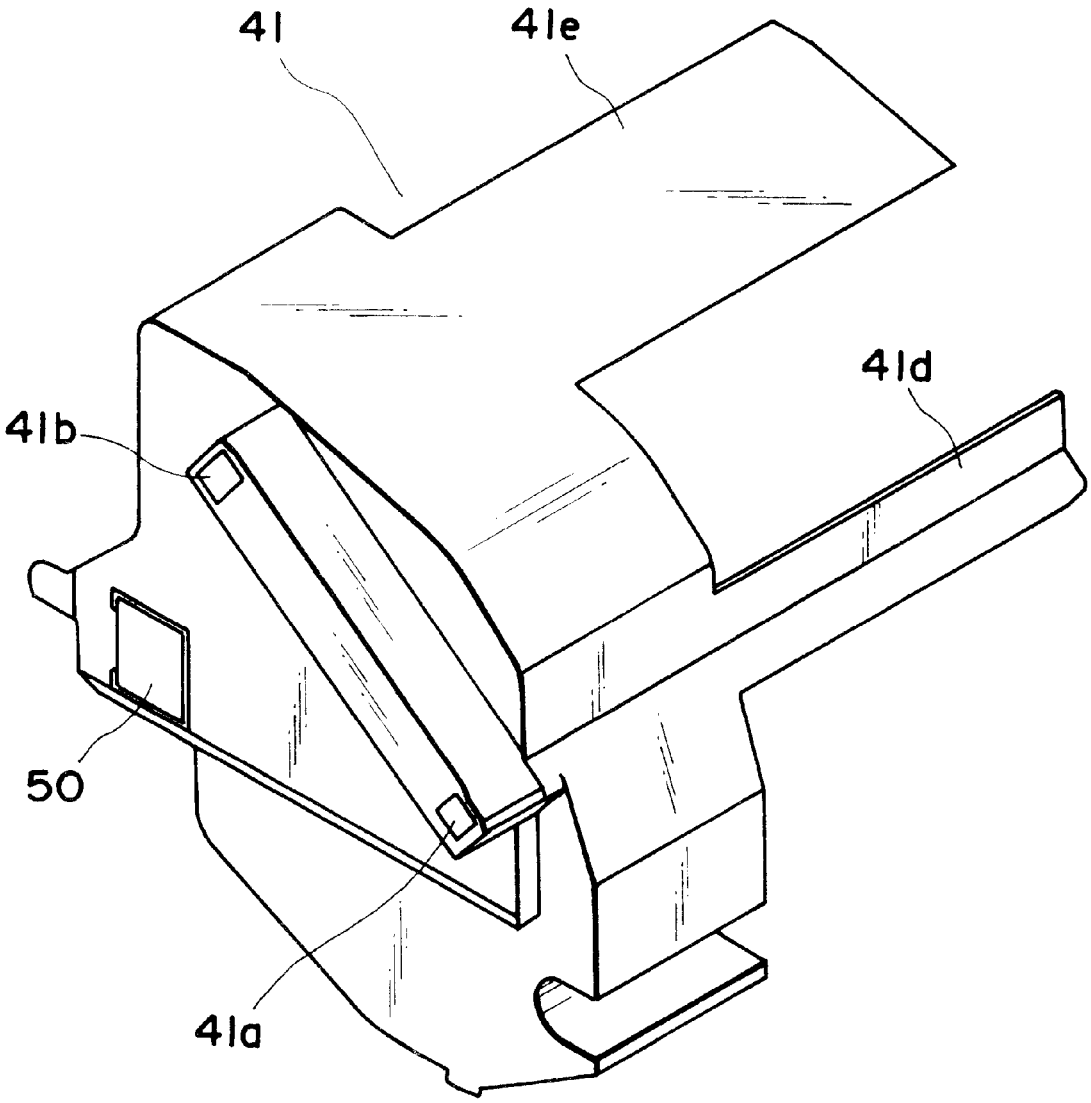
FIG. 9 is a perspective view of a cover for a developing cartridge of FIG. 8.
Figure 10:
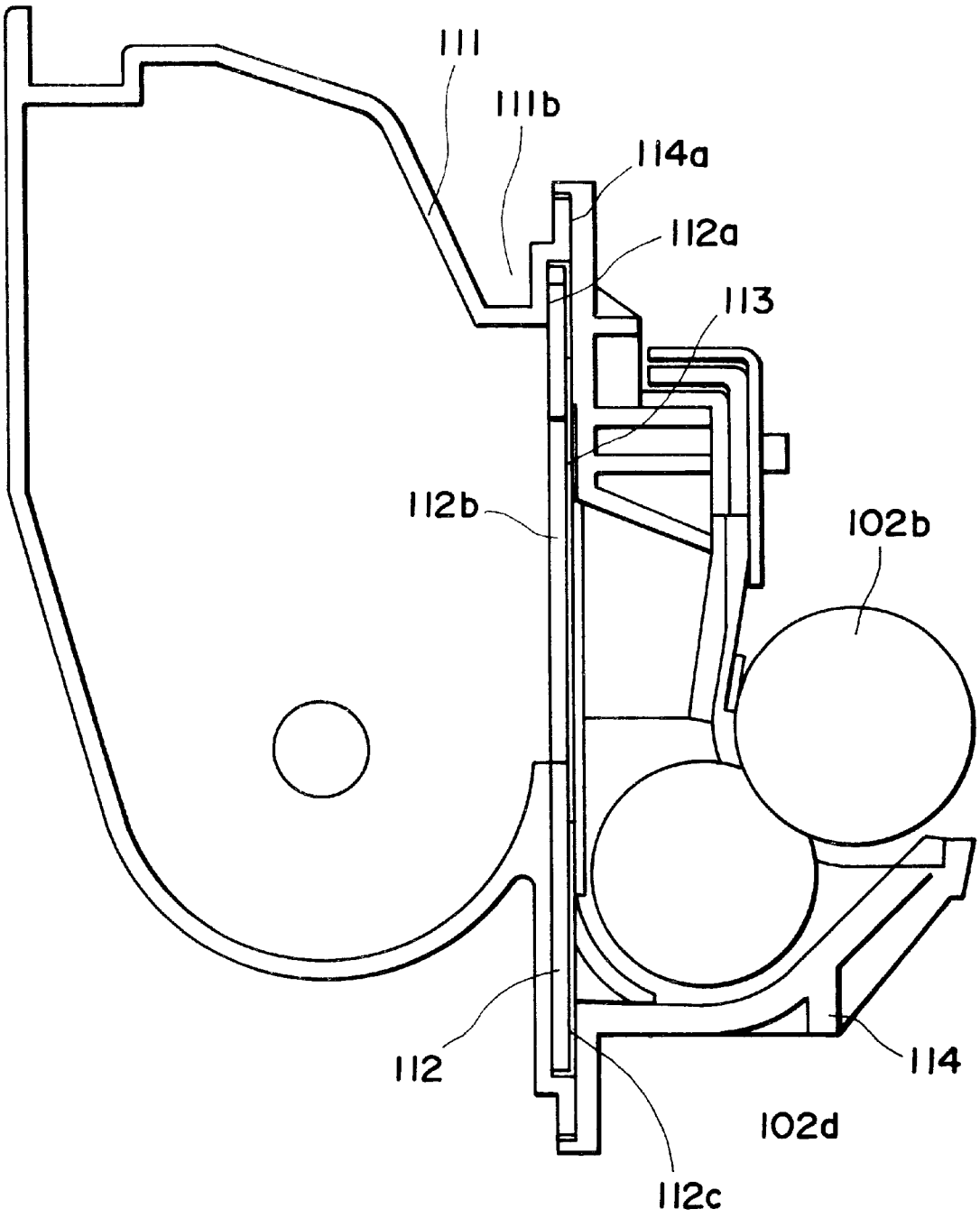
FIG. 10 is a side view for illustrating the advantages of this embodiment.

Referring to FIGS. 2–9, the color developing cartridge (8Y, 8M, 8C) will be disclosed in detail. FIG. 2 is a sectional view of a color developing cartridge according to an embodiment of the present invention. FIG. 3 is a perspective view of a seal member and parts there around of a developing cartridge according to an embodiment of the present invention. FIGS. 4 and 5 are perspective views of a light transmission port and a light guide and parts there around of a color developing cartridge according to another embodiment of the present invention. FIG. 6 is a perspective view of a toner frame. FIG. 7 is a top plan view of a color developing cartridge. FIG. 8 is a perspective view of a color developing cartridge according to another embodiment of the present invention. FIG. 9 is a perspective view of a cover. FIG. 10 is a side view for illustrating effects of this embodiment.

In a color developing cartridge (8Y, 8M, 8C) shown in FIG. 2, a cap member 32, on which a flexible toner seal 34 is welded, is welded on a developing frame 31 using a welding rib 32*a*. The frame 31 of the color developing cartridge (8Y, 8M, 8C) is provided with openings 36*a*, 36*b* formed by an insertion molding, and a toner frame 45 having a toner container 33 with light transmission ports provided with light transmission members, is welded by a welding rib portion 33*a* to the openings 36*a*, 36*b*, thus forming a unit. Thereafter, toner T (developer (toner)) is supplied into the toner accommodating container 33 through the toner filling opening 33*c* (FIG. 7). After the toner filling, the part such as the supplying rollers 8YR, 8MR, 8CR and the developing rollers 8YS, 8MS, 8CS are mounted to the developing frame 31. Thus, each of the developing cartridges (8Y, 8M, 8C) is manufactured. Designated by 31*d* is a developing roller mounting portion provided in the developing frame 31, and the developing roller (8YS, 8MS, 8CS) is positioned there. Designated by 31*e* is a supplying roller mounting portion, and the supplying roller (8YR, 8MR, 8CR) is positioned there.

As shown in FIGS. 2 and 3, a cap member 32 having an opening 32*b* of a predetermined size is welded to the developing frame 31 all around the four sides thereof using the welded rib portion 32*a* through ultrasonic welding, vibrating welding, or the like. A toner frame 45 having a toner accommodating container 33, which has an opening 33*b* of a predetermined size and which functions to accommodate the toner, is welded to the developing frame 31 all around the four sides thereof by the welded rib portion 33*a* through ultrasonic welding, vibration welding, or the like.

The cap member 32 is disposed so as to confine a part of the opening region 33*b* of the toner container 33. As shown in FIG. 3, a toner seal 34 for hermetically closing the opening 32*b* of the cap member is separably mounted through welding or the like to the cap member 32. The toner seal 34 is mounted to such a side of the cap member 32 as has the supplying roller 8YR, 8MR 8CR.

When the user uses the color developing cartridge (8Y, 8M, 8C), the toner seal 34 is pulled out through the toner seal opening 31*a* of the developing frame 31 in the direction of arrow A away from the sheet of the drawing of FIG. 3, prior to mounting the color developing cartridge (8Y, 8M, 8C) to the main assembly 80 of the apparatus. By doing so, the toner accommodated in the toner container 33 is discharged through the opening 32b of the toner cap member 32, and is supplied to the supplying roller 8YR, 8MR, 8CR or the like in the developing frame 31.

As shown in FIG. 3, the toner seal opening 31*a* is formed downstream of the opening 32*b* of the cap member 32 with respect to the toner seal pulling direction (indicated by the arrow A). The toner seal opening 31a has an elongated configuration extended along a short side of the developing frame 31 having a substantially rectangular configuration.

The toner seal 34 is pulled out and removed through the toner seal opening 31*a* in a direction different from the direction along the side surface 32*c* on which the toner seal 34 is welded, namely in the direction away from the sheet of the drawing of FIG. 3. Therefore, all of the four sides of the cap member 32 can be welded to the developing frame 31, by which the welding strength between the cap member 32 and the developing frame 31 can be assured. Thus, toner can be prevented assuredly from leaking between the cap member 32 and the developing frame 31.

The toner seal may be an easy-peel type by which the opening 32*b* is unsealed by peeling or may be a tear-tape type or the like, by which the opening 32*b* is unsealed by tearing.

As shown in FIG. 3, an elastic seal member 35 is extended between the cap member 32 and the developing frame 31 in the longitudinal direction of the toner seal opening 31*a* of the developing frame 31. Therefore, the toner discharged through the opening 32*b* of the cap member 32 does not leak through the toner seal opening 31*a* of the developing frame 31.

With this structure, the toner frame 45 having the cap member 32 and the toner accommodating container 33 is welded to the developing frame 31 all around the four sides thereof, and has a proper strength balance. Therefore, the toner accommodating container 33 and the developing frame 31 are warped. Additionally, the welded portion is not peeled even upon the vibration, falling, or the like.

The cap member 32 and the toner frame 45 are welded to the developing frame 31 at the four sides thereof. For this reason, the seal member 35 is strongly compressed between the cap member 32 and the seal member 35. Thus, toner is prevented from leaking through the toner seal opening 31*a* formed in the developing frame 31.

As shown in FIG. 2, in this embodiment, after the cap member 32 is welded to the developing frame 31 by using the welded rib portion 32*a,* the toner frame 45 is welded to the developing frame 31 by using the welded rib portion 32*a.* In the B parts in FIG. 2, when the cap member is welded to the developing frame 31, the welding operation can be carried out without the toner frame 45 mounted. Therefore, during the welding operation, a receptor portion (unshown) of a tool for the welding operation can support the cap member 32 without any problem. When the toner frame 45 is welded to the developing frame 31 after the cap member 32 is welded to the developing frame 31, what is required is to provide, in the toner accommodating container 33, a relatively shallow space 33*c* shallow enough to permit the receptor portion (unshown) of the tool for the welding operation to enter toward the toner frame 45 (toner accommodating container 33). The space 33*c* may be small, and therefore, the size of the toner accommodating container 33 can be increased, thus increasing the toner accommodation capacity. When the toner frame 45 and the developing frame 31 are welded to each other, the portion of the space 33*c* is supported by a receptor portion (unshown) of the tool.

Referring to FIG. 10, the effects of this embodiment will be described. What is disclosed in FIG. 10 is not known, but has been considered by the inventors during the development of the present invention.

With the structure shown in FIG. 10, the toner frame 111 and the cap member 112 are welded by using the welded rib portion 114*a* for welding the toner frame 111 and the cap member 112 to each other and by using the welded rib portion 114*a* for welding the toner frame 111 and the developing frame 114 are welded to each other, and then the toner frame 111 and the developing frame 114 are welded to each other. In other words, the cap member 112 is welded to the toner frame 111. Therefore, it is required that space 111*b* for inserting the receptor portion (unshown) of the tool for the welding operation has a relatively large depth. Therefore, the toner filling capacity of the toner frame 11 is smaller correspondingly.

According to this embodiment, however, the developing frame 31 and the toner frame 111 are welded to each other after the developing frame 31 and the cap member 32 are welded to each other. As will be apparent, if the space 33*c* shown in FIG. 2 and the space 111*b* shown in FIG. 10 are compared with each other, more toner can be accommodated by the FIG. 2 structure.

The foregoing embodiment can be summarize as follows:

The embodiment relates to a developing cartridge (8Y, 8M, 8C) for developing a latent image formed on the photosensitive member (3), wherein said developing cartridge is detachably mountable to a main assembly (1) of an electrophotographic image forming apparatus, the developing cartridge comprising;

a developing member (e.g. one of developing rollers 8YS, 8MS, 8CS) for developing a latent image formed on the electrophotographic photosensitive member (3) with toner (T);

a toner accommodating portion (e.g. toner accommodating container 33) for accommodating the toner (T) to be used for development by the developing member;

a toner supply opening (33*b*), provided in the toner accommodating portion (33), for supplying the toner (T) accommodated in the toner accommodating portion (33) to the developing member;

a toner seal (34) for blocking the toner from being supplied from the toner supply opening (33*b*) toward the developing member;

a developing frame (31) including a developing member mounting portion (31*d*) for mounting the developing member, the developing frame (31) being provided with a toner passing opening for passing the toner supplied from the toner supply opening (33*b*);

a toner frame (45) supporting the toner accommodating portion (33), the toner frame (45) and the developing frame (31) being bonded together all around their peripheries; and a toner seal opening (31*a*) for passing the toner seal (34) provided between the toner passing opening (31*e*) of the developing frame (45) and a boding portion between the toner frame and the developing frame, wherein the toner seal (34) is pulled out along the toner seal opening (31*a*) prior to the start of use of the developing cartridge (8Y, 8M, 8C), thereby permitting the toner to be supplied from the toner supply opening (33*b*) toward the developing member.

A toner relating plate (e.g. cap member 32) having an opening region (32*b*) of a predetermined size for limiting the amount of the toner (T) supplied from the toner supply opening (33*b*), is provided in the developing frame 31 opposed to the toner supply opening (33*b*). Here, the toner seal (34) is mounted on the toner regulating plate (32).

The toner seal opening (31*a*) is disposed at an end opposite from an end adjacent to which the developing bias contact (50) is provided in a longitudinal direction of the developing frame (31), wherein the developing bias contact (50) receives a developing bias to be supplied from the main assembly (1) to said developing member (8YS, 8MS, 8CS) when the developing cartridge (8Y, 8M, 8C) is mounted to the main assembly (1) of the apparatus, and the developing bias contact (50) is exposed at a longitudinal end of the developing cartridge (8Y, 8M, 8C). When the developing cartridge (8Y, 8M, 8C) is mounted to the main assembly 1 of the apparatus, the developing bias contact (50) is electrically connected with a main assembly developing bias (60) to receive the developing bias from the main assembly 1. The toner seal opening (31*a*) is disposed at the same end portion where a toner filling opening (33*c*) is provided in the toner accommodating portion (33) to fill the toner into the toner accommodating portion (33), in a longitudinal direction of the developing frame (31).

A cover (41) is detachably mounded at an end of the developing cartridge (8Y, 8M, 8C), wherein the cover is provided with the developing bias contact (50).

The developing frame (31) and the toner passing opening have substantially rectangular shapes, and the toner seal opening (31*a*) is disposed between a short side of the rectangular shape of the developing frame (31) and a short side of the rectangular shape of the toner passing opening and the toner seal opening (31*a*) is an elongated opening extended along a short side of the rectangular shape of the developing frame (31).

The toner frame (33) and developing frame (31) are bonded with each other all around their peripheries by adhesive material, welding, or ultrasonic welding.

In FIG. 2, light transmission ports 36*a,* 36*b* for toner remaining amount detection are formed through insertion molding upon integral molding of the toner accommodating container 33. An integral molding method for the toner accommodating container 33 includes a transition timing of shifting (mold opening process, mold sliding process) from a primary molding step (for simultaneous molding of the toner frame 45 (toner accommodating container 33) and cap member 32) to a secondary molding step (for jointing the toner cap member 45 (toner accommodating container 33) and the cap member 32 by resin material molding). So, the formation of the light transmission ports 36*a,* 36*b* in the toner accommodating container 33 by insertion molding during the shifting step, does not result in a cost increase. As for the material of the light transmission members, polystyrene or the like resin is usable.

While the toner accommodating container 33 may be molded, the light transmission members 36*a*1, 36*b*1 may be formed simultaneously, and they may be inserted into the toner accommodating container 33, by which the insertion can be carried out when the material defining the light transmission ports 36*a,* 36*b* are not yet completely cooled, and therefore, the strain or dimension change is small.

In FIG. 3, designated by 31*b* is a developing blade positioning pin, and 31*c* is a cover.

As shown in FIGS. 2, 4 and 5, the detected light L emitted from the emission lamp 39*a* for detection of the toner remaining amount provided in the main assembly 1 of the image forming apparatus, travels through a first light guide (light transmission member) 37 and is reflected by an inclined surface 37*a* inclined by 45° relative to the direction of the entering detection light L, and travels through the light transmission ports 36*a,* 36*b;* and then, it is reflected by an inclined surface 38*a* inclined by 45° relative to the direction of the entering detection light L of the second light guide (light transmission member) 38, and travels through the second light guide (light transmission member) 38 and is finally received by a photo-receptor sensor 39*b* for detecting the toner remaining amount provided in the main assembly 1.

Here, the first and second light guides (light transmission member) 37 and 38 are directly mounted to the outer surface of the toner accommodating container 33. As described in the foregoing, the light transmission ports 36*a,* 36*b* are formed in the toner accommodating container 33 by insertion molding. Therefore, the positional accuracy of the first and second light guides (light transmission members) 37 and 38 relative to the light transmission port 36*a* and 36*b* can be assured by assuring the positional accuracy between the mounting seat for the first and second light guides (light transmission members) 37 and 38 and the light transmission port 36*a* and 36*b*. In this embodiment, the supporting member 45 is positioned by a positioning pin 45*a* integrally molded with the toner frame 45. Therefore, the positional accuracy of the first and second light guide 37 and 38 relative to the light transmission port 36*a* and 36*b* is improved.

The first and second light guides (light transmission member) 37, 38 extend in parallel with the longitudinal direction of the color developing cartridges 8Y, 8M, 8C, so that even when the color developing cartridges 8Y, 8M, 8C are mounted on a revolvable developing turret 8*b,* the entering direction of the detected light L is always parallel with the axis of revolution of the developing turret 8*b*. Therefore, if positioning is assured between the emission lamp 39*a* and the photo-receptor sensor 39*b* and the first, second light guides (light transmission members) 37, 38, the detection light L can be assuredly passed through the light transmission ports 36*a,* 36*b*.

As shown in FIG. 2, in this embodiment, the first and second light guides (light transmission members) 37, 38 are disposed across the welding rib portion 33*a,* which is a welded portion between the toner frame 33 and the developing frame 31 from the developing rollers 8YS, 8MS, 8CS and the supplying rollers 8YR, 8MR, 8CR. Therefore, the toner scattered from the developing rollers 8YS, 8MS, 8CS, supplying rollers 8YR, 8MR, 8CR and the like, is stopped at the welding rib portion 33*a,* which is the welded portion. For this reason, the first and second light guides (light transmission members) 37 and 38 are not easily contaminated by the scattered toner.

As shown in FIG. 5, the first and second light guides 37, 38 are covered by a cover member 41 provided at the side surface portion of the color developing cartridge 8Y, 8M, 8C except for the exposed portions 37*b,* 38*b* opposed to the light transmission ports 36*a,* 36*b*. Therefore, even if the toner scatters through the welded portion between the toner frame 45 and the developing frame 31, the first and second light guides (light transmission members) 37, 38 are not easily contaminated.

Because the portions 37*b,* 38*b* of the first and second light guides 37, 38 are exposed, the mounting thereof can be easily checked in the assembling plant of the color developing cartridge. Additionally, the user can easily check the toner remaining amount by observation through the light transmission ports 36*a,* 36*b* and the exposed portions 37*b,* 38*b* of the first and second light guides (light transmission member) 37, 38.

As shown in FIG. 8, by substantially completely covering first and second light guides 37, 38 by extensions 41*d,* 41*e* of the cover member 41, deposition of the toner can be assuredly prevented, so that function deterioration of the light guides 37, 38 can be avoided.

The longitudinal ends of the first and second light guides 37*a* and 38 are supported by supporting portions 41 a and 41*b* of the cover member 41, respectively, so that the positional deviation or the like of the first and second light guides 37 and 38 due to vibration, falling, or the like can be prevented.

A toner stirring member 42 (FIG. 2) disposed in the toner accommodating container 33, is assembled simultaneously with the integral molding of the toner accommodating container 33. By detecting a transmission factor of the detecting light L when the toner is stirred in the toner accommodating container 33 by the rotation of the toner stirring member 42, the remaining amount of the toner in the accommodating container 33 is detected by the main assembly 1 of the apparatus. When the main assembly 1 detects that the remaining amount of the toner decreases to a predetermined amount, the main assembly 1 carries out exchange notification (flickering of the lamp or the like) (level 1). When it detects further reduction of the remaining amount of the toner, it stops the operation of the main assembly 1 (level 2). The first and second light guides 37*a* and 38 are made of polymethylmetaacrylate resin material.

The foregoing embodiment can be summarized as follows:

It relates to a developing cartridge (8Y, 8M, 8C) for developing a latent image formed on the photosensitive member (3), wherein the developing cartridge is detachably mountable to a main assembly (1) of an electrophotographic image forming apparatus, the developing cartridge comprising:

a developing member (e.g. one of developing rollers 8YS, 8MS, 8CS) for developing a latent image formed on the electrophotographic photosensitive member (3) with toner (T);

a toner accommodating portion (e.g., toner accommodating container 33) for accommodating the toner (T) to be used for development by the developing member;

a first light transmitting portion (36*a*) and a second light transmitting portion (36*b*) provided in the toner accommodating portion (33);

a first light guide (37) for directing, to the first light transmitting portion (36*a*), light emitted by a light emission member (e.g. emission lamp 39*a*) provided in the main assembly (1); and a second light guide (38) for directing the light having passed through the second light transmitting portion (36*b*) to a light receiving element (e.g. photo-receptor sensor 39*b*) provided in the main assembly (1).

By this, the main assembly (1) of the apparatus can be notified of a decrease of the toner amount accommodated in the toner accommodating portion (33).

The first light transmission portion (36*a*) and the second light transmitting portion (36*b*) are disposed at positions closer to a longitudinal end where a developing bias contact (50) is provided than the opposite longitudinal end, wherein the developing bias contact (50) receives a developing bias to be supplied to the developing member from the main assembly (1) when the developing cartridge (8Y, 8M, 8C) is mounted to the main assembly (1), and wherein the developing bias contact (50) is exposed at a longitudinal end of the developing cartridge (8Y, 8M, 8C).

An end of the first guide (37) is opposed to the first light transmitting portion (36*a*), and the other end thereof is exposed at the end of developing cartridge (8Y, 8M, 8C) where the developing bias contact (50) is provided.

The first light guide (37) is positioned below the second light guide (38) when the developing cartridge (8Y, 8M, 8C) is mounted to the main assembly (1).

A filling opening (33*c*) for filling the toner (T) into the toner accommodating portion (33) is provided at an end opposite from an end where the developing contact (5) is provided, in the longitudinal direction of the toner accommodating portion (33).

A cover (41) is detachably mounted to an end of the developing cartridge (8Y, 8M, 8C), wherein the first light guide (37) and the second light guide (38) are covered by an extension (41*d*, 41*e*) of the cover (41), and the cover (41) is provided with the developing bias contact (50) and openings (41*a*, 41*b*) for exposing end surfaces of the first light guide (37) and the second light guide (38).

According to this embodiment, the toner stirring member 42 disposed in the toner accommodating container 33 is assembled simultaneously with the integral molding of the toner accommodating container 33, so that the time required for the toner stirring member 42 assembling operation can be reduced, and therefore, the operation efficiency in the assembling can be improved. As shown in FIG. 4, to the opening 45*c* provided in the toner frame 45, a gear (unshown) for transmitting the driving force for rotating the toner stirring member 42 is engaged.

Referring to FIG. 7, designated by 70 is a cartridge positioning pin for positioning the cartridge by engagement with the main assembly when the developing cartridge is mounted to the main assembly 1.

According to this embodiment, the toner seal pulling direction is made different from the direction of the surface on which the seal is welded to the cap member and the cap member is welded to the developing frame all around its circumference. Therefore, the proper strength balance in the structure is accomplished, and the warping of the toner frame and the developing frame can be avoided with high durability against vibration, falling, or the like.

The toner frame is molded by an integral molding method, and the light transmission ports for toner remaining amount detection are formed in the toner accommodating container by insertion molding, so that a larger amount of the toner can be accommodated by the same space as a conventional toner accommodating container. If the capacities are the same, the space occupied by the toner accommodating container can be reduced. By this, the main assembly of the image forming apparatus can be downsized.

With the foregoing structure, the positioning between the light transmission member and the light transmission port can be assured, so that light for the toner remaining amount detection can be assuredly passed with high accuracy. By the provision of the light guide on the developing frame side, the light guide can be exchanged together with the developing cartridge even if the light guide is contaminated. Therefore, the light guide always becomes fresh by the exchange of the developing cartridge. Thus, it is not necessary to assure the functions of the light guide up to the end of the lifetime of the main assembly of the image forming apparatus, and therefore a cost reduction is possible by omitting the cleaning means or the like for the light guide.

When the light guide is covered by the cover member, the light guide is protected from contamination with the deposition of scattered toner, so that a decrease of the light transmission factor can be avoided, and therefore, erroneous detection of the remaining amount of the toner can be prevented.

While the invention has been described with reference to the structure disclosed herein, it is not confined to the details set forth in this application is intended to cover such modifications or changes as may come within the purposes of the improvements or the scope of the following claims.

What is claimed is:

1. A developing cartridge for developing an electrostatic image formed on an image bearing member with toner, said developing cartridge being detachably mountable to a main assembly of an image forming apparatus, comprising:

a toner carrying member for carrying toner to a developing position of the image bearing member;

a developing frame supporting said toner carrying member and provided with an opening;

a toner frame, provided with an opening, for accommodating the toner;

a covering member provided in said developing frame and having an opening; and a sealing member for sealing the opening of said covering member to prevent the supply of the toner from said toner frame to said developing frame, wherein when said opening of said covering member is unsealed, the toner is permitted to be supplied from said toner frame through the opening of said toner frame, the opening of said covering member and the opening of the developing frame to said developing frame;

wherein said toner frame and said developing frame are secured to each other all around the periphery of the openings thereof, and said developing frame and said covering member are secured to each other all around the periphery of the openings thereof;

wherein after said sealing member is mounted to said covering member, said covering member is adhered to the developing frame, and then said developing frame is adhered to said toner frame.

2. A developing cartridge according to claim 1, wherein a portion where said toner frame and said developing frame are adhered and a portion where said toner frame and said covering member are adhered, are provided with respective welded ribs.

3. A developing cartridge according to claim 1, wherein said developing cartridge is provided with an opening for permitting said sealing member to be pulled when said sealing member is removed.

4. A developing cartridge according to claim 1, wherein said toner frame and said developing frame are secured to each other all around the periphery of the openings thereof by welding, and said developing frame and said covering member are secured to each other all around the periphery of the openings thereof by welding.

5. A developing cartridge according to claim 4, wherein the welding is ultrasonic welding.

6. A developing apparatus for developing an electrostatic image formed on an image bearing member with toner, comprising:

a developing frame supporting a toner carrying member for carrying toner to a developing position, said developing frame being provided with an opening;

a toner frame, provided with an opening, for accommodating the toner;

a covering member provided in said developing frame and having an opening; and a sealing member for sealing the opening of said covering member to prevent supply of the toner from said toner frame to said developing frame, wherein when said opening of said covering member is unsealed, the toner is permitted to be supplied from said toner frame through the opening of said toner frame, the opening of said covering member and the opening of the developing frame to said developing frame;

wherein said toner frame and said developing frame are secured to each other, and said developing frame and said covering member are secured to each other, and wherein after said sealing member is mounted to said covering member, said covering member is adhered to the developing frame, and then said developing frame is adhered to said toner frame.

* * * * *

UNITED STATES PATENT AND TRADEMARK OFFICE

CERTIFICATE OF CORRECTION

PATENT NO. : 6,101,352

DATED : August 8, 2000

INVENTOR(S) : KOUJI HASHIMOTO, ET AL.

It is certified that error appears in the above-identified patent and that said Letters Patent is hereby ON THE COVER PAGE, AT [56] References Cited, Foreign Patent Documents: "9-969958" should read –9-96958--.

COLUMN 1:

Line 50, "an" should read –a--.

COLUMN 2:

Line 5, "there around" should read –therearound--.

Line 8, "there around" should read –therearound--.

Line 12, "there around" should read –therearound--.

UNITED STATES PATENT AND TRADEMARK OFFICE

CERTIFICATE OF CORRECTION

PATENT NO. : 6,101,352

DATED : August 8, 2000

INVENTOR(S): KOUJI HASHIMOTO, ET AL.

It is certified that error appears in the above-identified patent and that said Letters Patent is hereby corrected as shown below:

COLUMN 8:

Line 19, "summarize" should read –summarized--.

Line 25, "comprising;" should read –comprising:--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*